US005452571A

United States Patent [19]

Okuyama et al.

[11] Patent Number: 5,452,571

[45] Date of Patent: Sep. 26, 1995

[54] WINDER-TO-DOUBLE TWISTER CONNECTING SYSTEM

[75] Inventors: Yasuo Okuyama, Ohtsu; Nobuo Sakamoto, Kyoto, both of Japan

[73] Assignee: Murata Kikai Kabushiki Kaisha, Kyoto, Japan

[21] Appl. No.: 225,513

[22] Filed: Apr. 11, 1994

Related U.S. Application Data

[63] Continuation of Ser. No. 795,933, Nov. 15, 1991, abandoned.

[30] Foreign Application Priority Data

| | | | |
|---|---|---|---|
| Nov. 17, 1990 | [JP] | Japan | 2-120649 U |
| Dec. 10, 1990 | [JP] | Japan | 2-410031 |
| Jan. 17, 1991 | [JP] | Japan | 3-004717 U |

[51] Int. Cl.[6] ..... D01H 9/04; D01H 9/14

[52] U.S. Cl. ..... 57/281; 57/58.52; 57/269; 57/274; 57/275; 57/278; 57/305; 57/306

[58] Field of Search ..... 242/35.5 A; 54/90, 54/269, 278, 274, 275, 303, 305, 306, 58.52, 281

[56] References Cited

U.S. PATENT DOCUMENTS

| | | | |
|---|---|---|---|
| 4,351,494 | 9/1982 | Schippers et al. | 57/281 |
| 4,555,067 | 11/1985 | Angelucci et al. | 242/35.5 A |
| 4,817,373 | 4/1989 | Gualchierani | 57/281 |
| 4,848,077 | 7/1989 | Kawarabashi et al. | 57/269 |
| 4,998,407 | 3/1991 | Matsui et al. | 57/281 |
| 5,062,261 | 11/1991 | Fink | 57/281 |
| 5,082,192 | 1/1992 | Langen et al. | 252/35.5 A X |
| 5,109,662 | 5/1992 | Inger | 57/275 X |
| 5,119,621 | 6/1992 | Inger | 57/281 |
| 5,207,051 | 5/1993 | Inger et al. | 57/90 X |
| 5,207,052 | 5/1993 | Fink et al. | 57/58.52 X |

*Primary Examiner*—Daniel P. Stodola
*Assistant Examiner*—William Strysewski
*Attorney, Agent, or Firm*—Spensley Horn Jubas & Lubitz

[57] ABSTRACT

A winder-to-double twister connecting system, which comprises a yarn end picking device for picking out a yarn end from a package set on a tray, a package lifter for inserting a two-piled empty bobbin mounting adapter received from an overhead conveyor, into the tray on a circulating conveyor line, and for transferring a two-piled package mounting adapter to the overhead conveyor; a bobbin mover for pulling off, from an adapter, an empty bobbin coming on the circulating conveyor line; a package loader for taking up the package with the yarn end picked out from the tray and mounting the package to the adapter; and a bobbin stripper for removing remaining yarn from the empty bobbin received from the bobbin mover.

9 Claims, 9 Drawing Sheets

WINDER-TO-DOUBLE TWISTER CONNECTING SYSTEM

This is a continuation of application Ser. No. 07/795,933 filed Nov. 15, 1991, now abandoned.

BACKGROUND OF THE INVENTION

1. Field of the Invention

The present invention relates to a winder-to-double twister connecting system and more particularly relates to a device for pulling off piled empty bobbins discharged from a double twister of piled feed yarn package-type, from an adapter, and mounting new packages fed from a winder onto the adapter.

2. Prior Art

In a prior-art device, removal from an adapter of piled empty bobbins discharged from a double twister of piled feed yarn package type and insertion of new packages onto the adapter have been manually performed.

According to the conventional double twister of piled feed yarn package-type, the manual replacement of the empty bobbin with a package takes much time and labor and is monotonous as well, and therefore is likely to be avoided.

It is, therefore, an object of the present invention to provide a winder-to-double twister connecting system which can fully automatically perform the replacement of an empty bobbin with a new package.

SUMMARY OF THE INVENTION

For attaining the above-mentioned object, the present invention provides a winder-to-double twister connecting system, which comprises a yarn end picking device for picking out a yarn end from a package set on a tray, a package lifter for inserting a two-piled empty bobbin mounting adapter received from an overhead conveyor, into the tray on a circulating conveyor line, and for transferring the two-piled package mounting adapter to the overhead conveyor; a bobbin mover for pulling off, from an adapter, an empty bobbin coming on the circulating conveyor line; a package loaders for taking up the package with the yarn end picked out from the tray and mounting the package to the adapter; and a bobbin stripper for removing remaining yarn from the empty bobbin received from the bobbin mover.

In the winder-to-double twister connecting system of the above-described constitution, the two-piled empty bobbin mounting adapter carried by the overhead conveyor is received by the package lifter, and set on a tray on the circulating conveyor line. The tray is circulated on the circulating conveyor line to the bobbin mover, where the empty bobbin is pulled off. Then, the package with its yarn end picked out by the package loader is taken up from the tray and mounted on the adapter. The adapter thus mounted with the two-piled packages is transferred to the overhead conveyor by means of the package lifter. In the meantime, the empty bobbin that has been pulled off by the bobbin mover is then transferred to the bobbin stripper, which in turn removes a residual yarn.

DETAILED DESCRIPTION OF PREFERRED EMBODIMENTS

Hereinafter a preferred embodiment of the winder-to-double twister connecting system according to the present invention will be explained with reference to the accompanying drawings.

Figure 1:
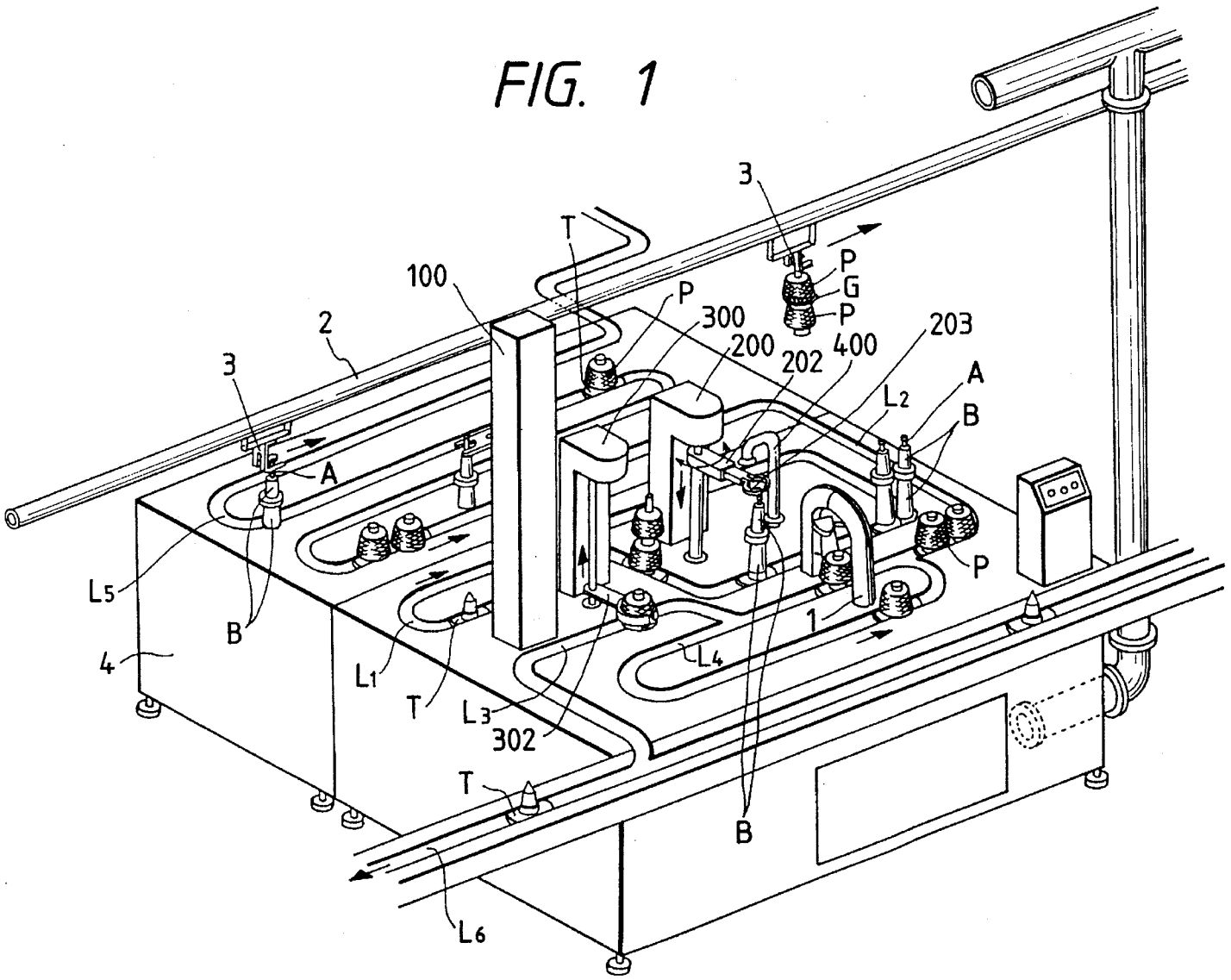
FIG. 1 is a perspective view of a winder-to-double twister connecting system according to the present invention.

First, this connecting system will be sketched by referring to FIG. 1.

This connecting system comprises a yarn end picking device 1 for picking out the yarn end from a package P fed on a tray T from a steam setter; a package lifter 100 which receives an adapter A mounted with a two-piled empty bobbin B carried on an overhead conveyor 2 from a double twister of piled yarn package type, mounts the adapter A on the tray T on the circulating conveyor line $L_1$, and further attaches the adapter A mounted with the two-piled package P to a hanger 3 of the overhead conveyor 2; a bobbin mover 200 for pulling off the empty bobbin unloaded onto the tray T on the circulating conveyor line $L_1$, from the adapter A; a package loader 300 for taking up the package P with the yarn end picked out, from the tray T, and mounting the package P to the adapter A; and a bobbin stripper 400 for removing a residual yarn from the empty bobbin B removed from the bobbin mover 200.

The circulating conveyor line $L_1$ is an endless conveyor line extending past the front of the bobbin mover 200, between the bobbin mover 200 and the package loader 300, and the front of the package lifter 100. On this circulating conveyor line $L_1$ are circulating several trays T, which are stopped in predetermined positions by each specific operation.

The package P wound with yarn by means of the winder is set after steaming by a steam setter not illustrated. The package P is Set on the tray T, and, in this state, conveyed to the conveyor line $L_5$ of the stocker conveyor, where the package P waits. From this place the package P is delivered onto a conveyor line $L_2$ every time when demanded, then being carried to the position of the yarn end picking device 1, where the yarn end will be picked out. This yarn end picking device 1 to be used is one in general use. In the event of a failure in picking out the yarn end, the package P is sent to a return conveyor line $L_4$, by which the package P is returned to the yarn end picking device 1.

Next, a spindle transfer mechanism using the package lifter 100 for transferring the adapter A mounted with a two-piled empty bobbin B and the adapter A mounted with a two-stage package P to the overhead conveyor 2 will be explained by reference to FIGS. 2 to 4.

The package lifter 100 is located beside the circulating conveyor line $L_1$ and has a hanger 101 which can stop at a delivery position for delivering the adapter A to the tray T on the circulating conveyor line $L_1$, at a wait position located above the delivery position, and at a position located about 5 mm above the wait position.

Figure 3:
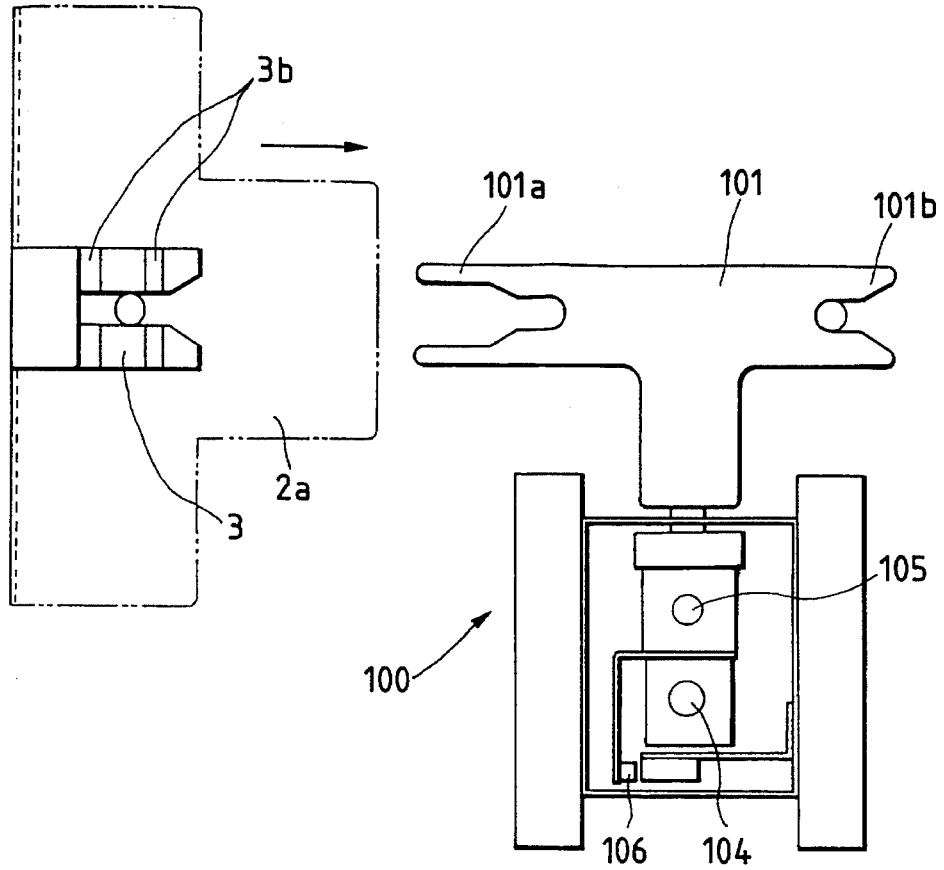
FIG. 3 is a plan view showing a relationship between a hanger of an overhead conveyor and a hanger of a package lifter.

As shown in FIG. 3, the hanger 101 is provided with an empty bobbin hook 101*a* and a package hook 101*b* formed on both sides, and is designed to move upward and downward with the rotation of a ball screw 104 engaged through with its base section. A numeral 105 refers to a guide bar for guiding the hanger 101 in a stabilized state during its upward and downward strokes. A numeral 106 denotes a sensor for controlling the stop of the hanger 101.

On the top end of the package lifter 100 is fixedly installed a bracket 102, which has rollers 103 to hold the overhead conveyor 2 from both sides.

On the other hand, the overhead conveyor 2 is a chain conveyor traveling within a protective pipe. From this chain are suspended hangers 3 through supporting plates 2*a* at a specific spacing. When the hanger 3 has arrived at the position of the package lifter 100, the rollers 103 come into contact with the supporting plate 2*a* to prevent the hanger 3 from swaying.

Figure 4:
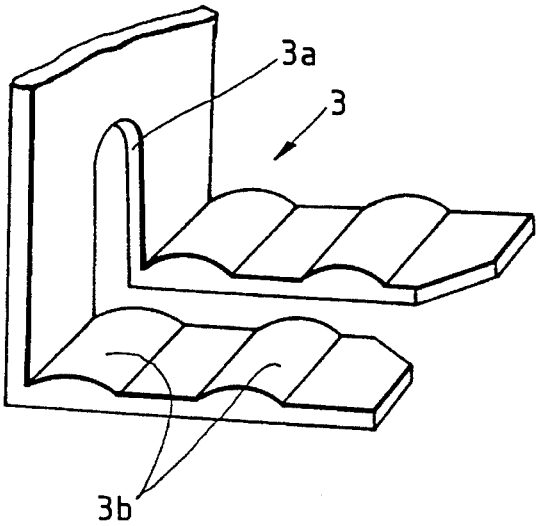
FIG. 4 is a perspective view of the hanger of the overhead conveyor.

The hanger 3 is a bifurcated member as shown in FIG. 4. An opening 3*a* of this bufurcated member extends as far as the rear wall section. Along this opening 3*a* are formed swelling sections 3*b* at the front and rear to firmly hold the adapter A received in the opening 3*a*, at the collar section of the upper stage thereof. The hanger 3 of the overhead conveyor 2 holding the two-piled empty bobbin mounting adapter A, as shown in FIG. 3, moves in the direction of the arrow from the empty bobbin hanger 101*a* side of the hanger 101 of the package lifter 100.

In the following, the transfer of package and empty bobbin from this state will be explained.

The hanger 101, holding the package mounting adapter A by the package hook 10l*b*, goes up as high as a standby position, and waits.

The hanger 3 of the overhead conveyor 2 moves to the position of the hook 101*a* and stops, and then pushes the two piled empty bobbin mounting adapter A into the hook 101*a*. At the same time, the hanger 101 goes about 5 mm up, raising the collar section of the lower stage of the two-piled empty bobbin mounting adapter A. In this state, the hanger 3 advances as far as the position of the hook 10lb of the hanger 101, where it stops, catching the package mounting adapter A held thereat. By a series of these operations, the two-piled empty bobbin mounting adapter A can be smoothly transferred to the hook 101*a*, with its head section passing through the opening 3*a* in the wall section behind the hanger 3, without interfering at the lower end of the collar section of the upper stage with the swelling sections 3*b*.

Simultaneously with the arrival of the hanger 3 at the hook 10l*b* position, the hanger 101 goes about 5 mm downward to thereby lower the collar section of the upper stage of the package mounting adapter A to between the swelling sections 3*b*. When the package mounting adapter A is thus received, the hanger 3 moves forward. On the other hand, the hanger 101 moves downward to place the two-piled empty bobbin mounting adapter A previously received, on the tray T waiting on the circulating conveyor line $L_1$.

Figure 5:
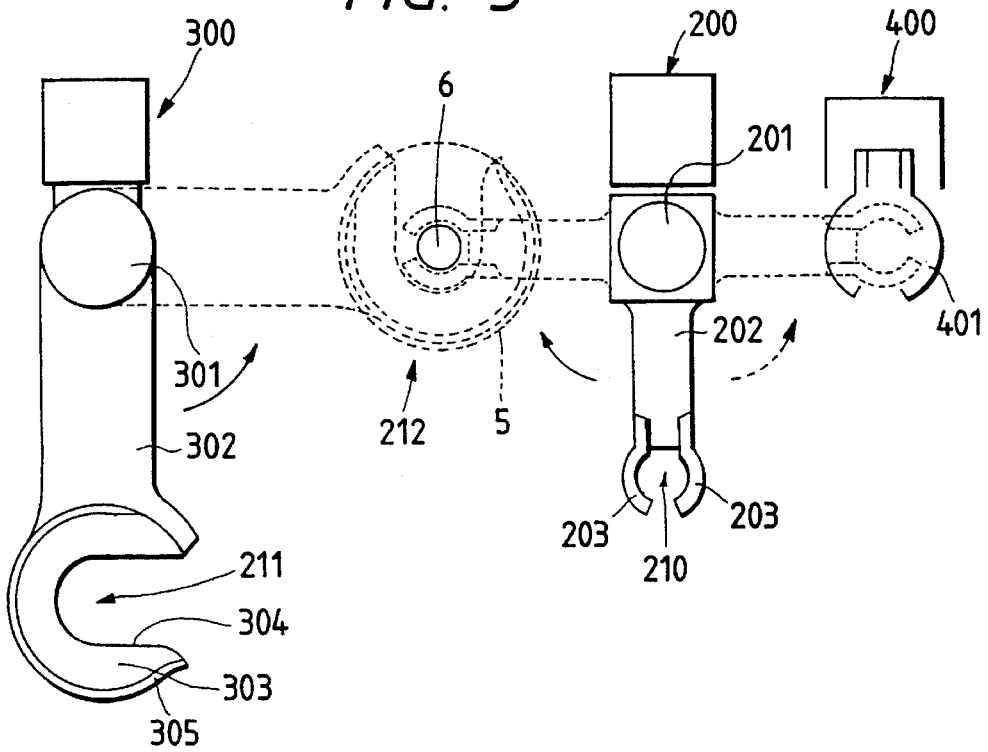
FIG. 5 is a schematic plan view showing a positional relation of a bobbin mover, a package loader and a bobbin stripper.

Next, a transfer device comprising the bobbin mover 200 and the package loader 300 will be explained with reference to FIG. 5.

The bobbin mover 200 has a chuck 203 at the forward end of a chuck support arm 202, which can move up and down along a vertical shaft 201 and rotate on the center of an empty bobbin removing position 210 to a transfer position 212 on the left and to a stripper 400 side on the right.

The chuck 203 is usually opened wider than the diameter of the adapter A and is pneumatically operated to hold the adapter A. The chuck support arm 202 usually waits above the empty bobbin removing position 210.

The package loader 300 has a package mounting section 303 at the forward end, which can move up and down along a vertical shaft 301, and also has a package support arm 302 which can rotate from the package receiving position 211 to the transfer position 212.

The package mounting section 303 is provided with an opening 304 and is designed so as not to interfere with a peg of the tray T when taking up the package P in the package receiving position 211. Around the package mounting section 303 is provided a guard wall 305 for preventing the lifted package P from falling. The package support arm 302 is usually down in the package receiving position 211, waiting for a next package. There comes a package mounting tray T on the conveyor line $L_3$ extending from the yarn end picking device 1, and then the package P rides onto the package mounting section 303.

In the mounting position 212 between the bobbin mover 200 and the package loader 300, there are provided a tray turning device 5 and a yarn end sucking device, which is not illustrated, in the circulating conveyor line $L_1$ and a yarn end sucking device 6, above the tray turning device 5, for sucking to hold the yarn end.

Figure 2:
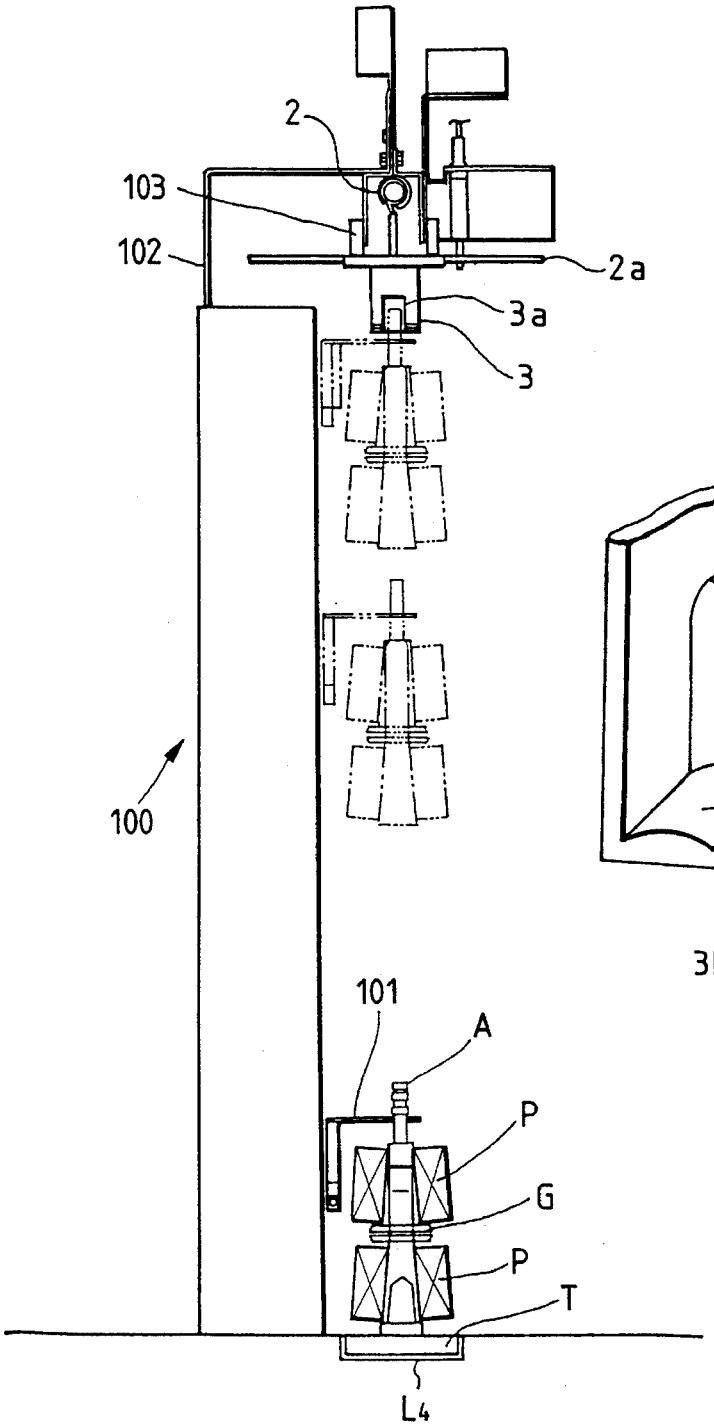
FIG. 2 is a side view of a package lifter.

On the other hand, between the two-piled packages P mounted on the adapter A is retained a release tension adjusting guide G as shown in FIG. 2. This. release tension adjusting guide G is retained when mounting an empty bobbin B also.

When the two-piled empty bobbin mounting adapter A has come on the circulating conveyor line $L_1$ to the bobbin removing position 210 and stopped, the chuck support arm 202 moves downward a little until the chuck 203 holds the upper-stage empty bobbin B. In this state, the chuck support arm 202 moves upward and turns toward the stripper side, where the chuck 203 releases the empty bobbin B, then returning to the former position.

In the meantime, in the transfer position 212 the tray T carrying the adapter A with the empty bobbin B pulled off by the bobbin mover 200 is waiting.

The package loader 300 functions to insert the package P onto the adapter A waiting in the transfer position 212 while the bobbin mover 200 is pulling off the upper-stage empty bobbin B. First, the package support shaft 302, while holding the package P, moves upward from the waiting position, then rotating as far as the transfer position 212. At this time, the yarn end sucking device 6 functions to suck the yarn end that has been picked out from the package P, and holds it. The package support arm 302 moves downward a little to unwind the yarn end from the package P, moves upward again to draw the unwound yarn end into the yarn end sucking device 6, and holds the yarn, keeping a specific length of yarn end. Subsequently, the package support arm 302 goes downward to insert the package P onto the adapter A, rising again to return to the waiting position 211.

The tray T with the package P pulled off is sent out from the conveyor line $L_3$ to the tray discharge conveyor line $L_6$.

At the uppermost part of the adapter A, with the upper-stage empty bobbin B removed, in the empty bobbin removing position 210, the release tension adjusting guide G is located. The package support arm 202 moves downward and the chuck 203 chucks the release tension adjusting guide G. Thereafter, the package support arm 202 goes upward and rotates to the transfer position 212, where it inserts the package with the release tension adjusting guide G held in the transfer position 212, onto the adapter A mounted with one package. Then, the package support arm 202 goes upward, returning to the waiting position 210.

Subsequently, the package support arm 302 rises from the waiting position 211 while holding the next package P, and rotates to the transfer position 212. At this time, the yarn end sucking device 6 operates to suck and hold the yarn end that has been picked out of the package P. The package support arm 302 then moves downward a little to release the yarn end from the package P, and goes upward again to suck the thus released yarn end into the yarn end sucking device 6, thus holding a specific length of yarn end. Next, the package support arm 302 goes downward to insert the package P onto the adapter A, then returning to the waiting position 211.

At the same time, the tray turning device 5 rotates, cooperating with a movable yarn guide not illustrated, to wind two yarn ends that have been sucked into the yarn end sucking device 6, on the upper end of the adapter A in the same direction of winding of the package P. Then, residual yarn ends are sucked into the adapter A by means of a yarn end sucking device not illustrated which is located beneath the transfer position 212.

The adapter A in the bobbin removing position 210 thus becomes empty, is released from a stop position by means of the stopper, and then goes on the circulating conveyor line $L_1$ as far as the transfer position 212 where the adapter A stops. The adapter A in the transfer position 212 is mounted with packages P in two stages, is released from the stop position by the stopper, and then goes on the circulating conveyor line $L_1$ as far as the position of the package lifter 100, where the adapter A stops.

Figure 6:
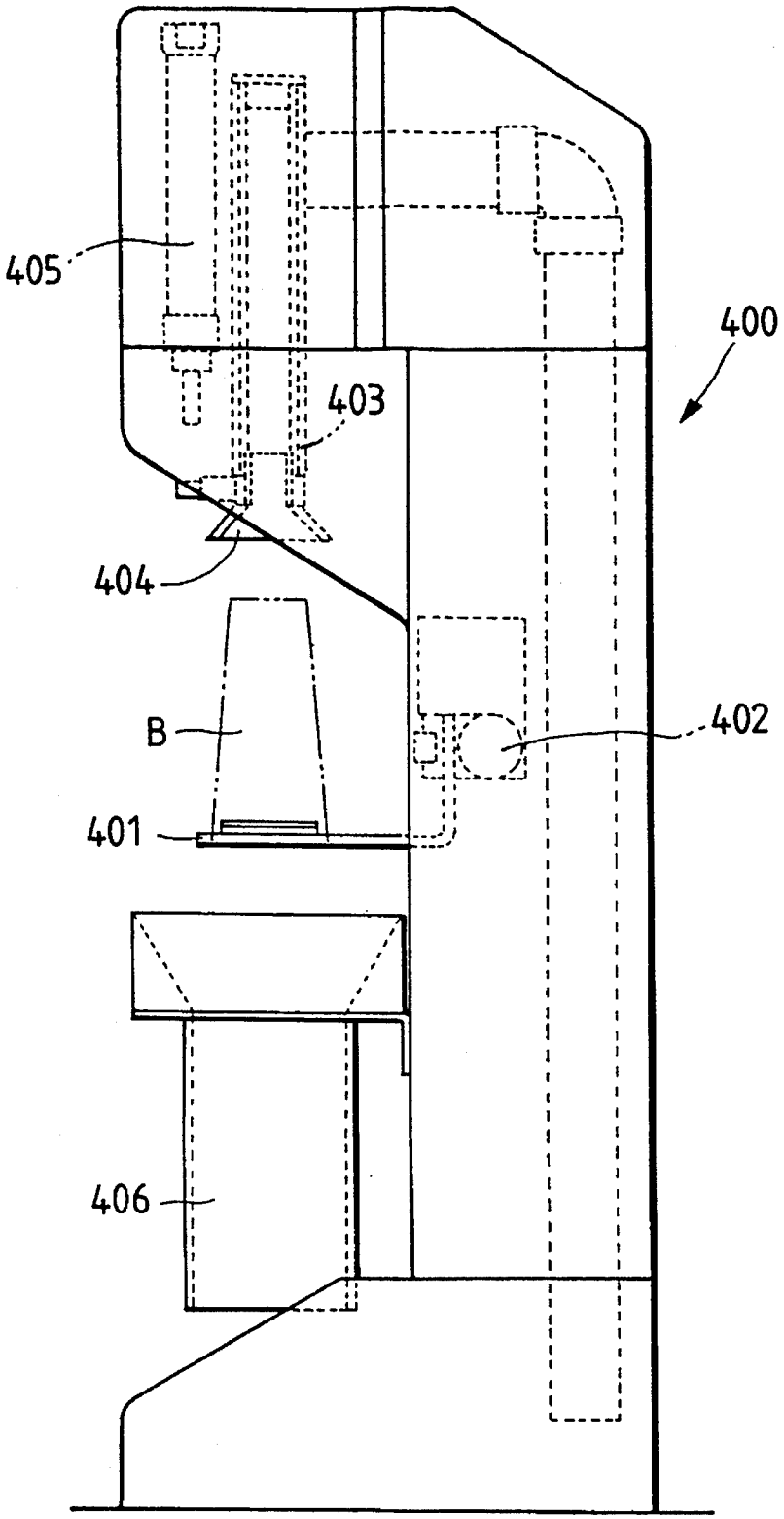
FIG. 6 is a side view of the bobbin stripper.
Figure 7:
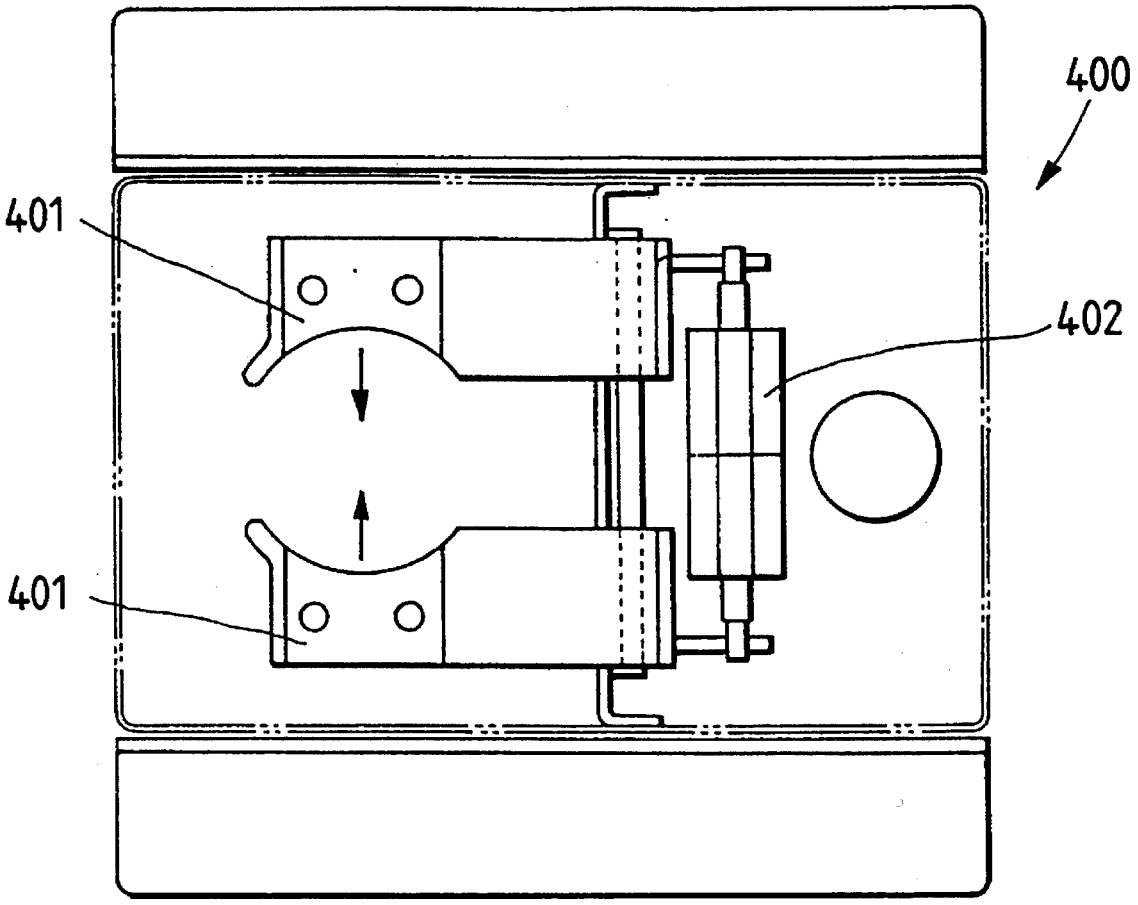
FIG. 7 is a plan view of a chuck section of the bobbin stripper.

Next, the bobbin stopper 400 will be explained with reference to FIGS. 5 to 7.

The package support arm 202 of the bobbin mover 200 pulls off the empty bobbin B from the adapter A in the empty bobbin removing position 210, then waiting in a position where the package support arm 202 turns through 90 degrees in the direction of the arrow, with the chuck 401 of the bobbin stripper 400 kept in an opened state.

The chuck 401 makes no change in its vertical position, but, being pneumatically operated by the air cylinder 402 to move to, and away from, the empty bobbin B. It approaches to chuck the empty bobbin B simultaneously with receiving the empty bobbin B.

Above the chuck 401 are provided a yarn suction pipe 403 communicating with a duct, and a pusher 404 which, slidably supported therein and pressed upward by a spring not illustrated, is moved downward by means of the air cylinder 405 during yarn stripping operation.

Below the chuck 401 is located an empty bobbin receiving vessel 406.

When the chuck 401 has chucked the empty bobbin B received from the chuck 203 of the package support arm 202, the air cylinder 405 operates to move the pusher 404 downward, thus pushing down the empty bobbin B. With the downward movement of the empty bobbin B, the chuck 401 gradually approaches the empty bobbin B with its opening adjusted to the conical outside diameter of the empty bobbin B. In case the yarn remains on the empty bobbin B, the yarn is scraped off from the empty bobbin B by the edge of the chuck 401. When the empty bobbin B has been fully lowered by the pusher 404, the pusher 404 moves a little upward, and the remaining yarn thus scraped off is sucked into the yarn suction pipe 403, being discharged out. The empty bobbin B drops into the empty bobbin receiving vessel 406.

The present invention, having the above-described constitution, has the following effect.

That is, it is possible to fully automatize empty bobbin and package transfer operation in the double twister of piled feed yarn package type.

Hereinafter a preferred embodiment of the yarn end preparing device will be explained with reference to FIGS. 8 and 9.

In the transfer position 212 between the bobbin mover 200 and the package loader 300, there are provided a tray revolving device 5 and a yarn end sucking device not illustrated, within the circulating conveyor line $L_1$, and a yarn end sucking device 6 for sucking and holding the yarn end above the circulating conveyor line $L_1$.

On the side facing the transfer position 212 of the bobbin mover 200, there are provided, in order from below, a lever 7 which approaches a lower-stage package from the waiting position above the package and can turn to a yarn hooking position and a position in which the yarn thus hooked is moved away from the package; a lever 8 which approaches the package from the waiting position, can turn to the yarn hooking position and the position in which the yarn thus hooked is moved away from the package, and moves up and down between the lower part of the lower-stage collar section 10 of the adapter A and the upper part of the upper-stage collar section 11; and a lever 9 with a cutter for cutting the yarn below the yarn end sucking device 6.

Figure 8:
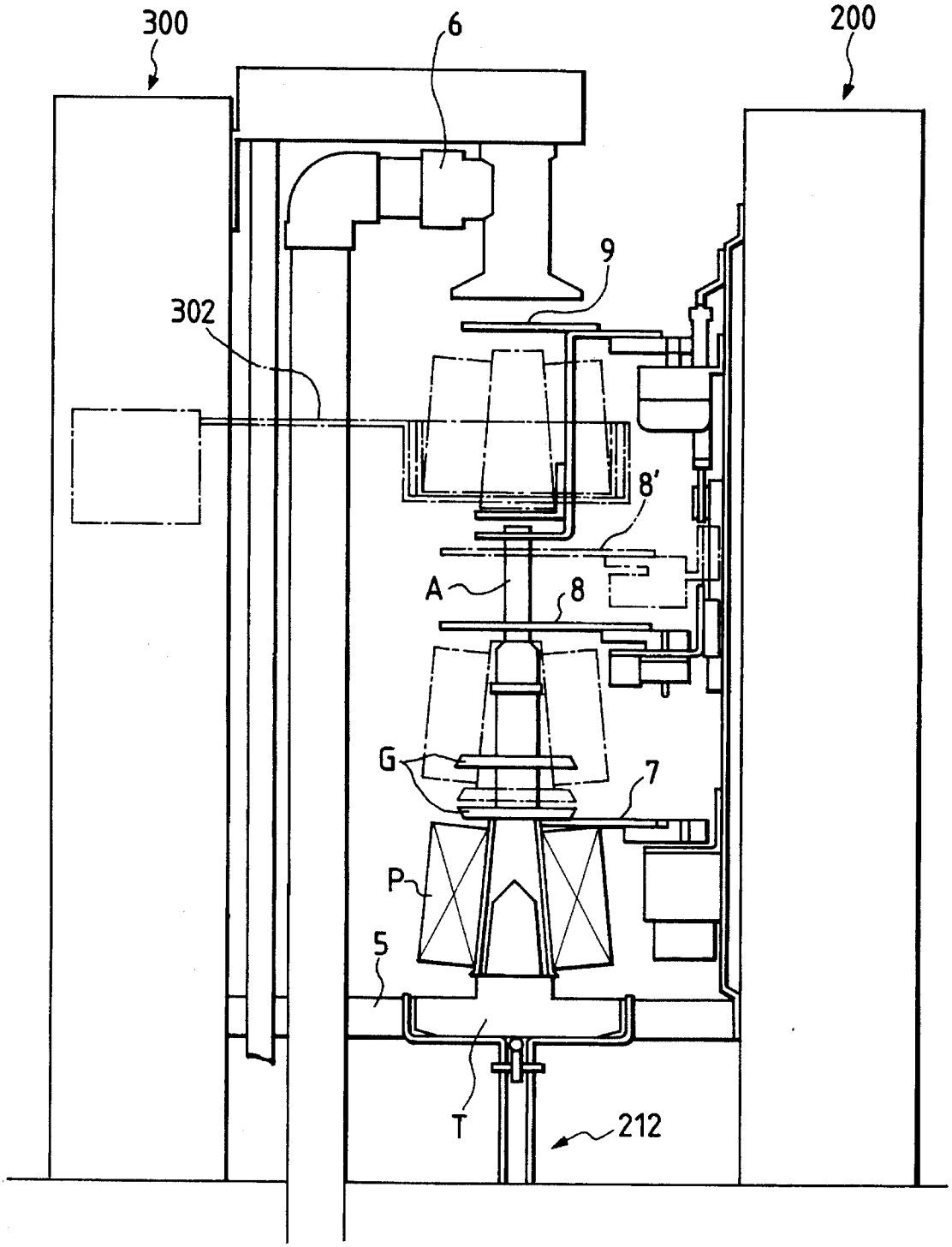
FIG. 8 is a side view of a yarn end preparing apparatus according to the present invention.

In the meantime, between the two-piled packages 2 mounted on the adapter A is held a release tension adjusting guide G as shown in FIG. 8. This is the same as in mounting empty bobbins B.

When such a two-piled empty bobbin mounting adapter A bring carried on the circulating conveyor line $L_1$ to the bobbin removing position 210 stops, the chuck support arm 202 moves a little downward to hold the upper-stage empty bobbin B with the chuck 203. In this state, the chuck support arm 202 moves upward and at the same time turns to the stripper 400 side, where the chuck 203 releases the empty bobbin B, then returning to the original position.

On the other hand, there waits, in the transfer position 212, the tray T mounted with the adapter A with the empty bobbin B removed by the bobbin mover 200.

The package loader 300 functions to insert the package P onto the adapter A while waiting in the transfer position 212 during the removal of the upper-stage empty bobbin B by the bobbin mover 200. First, the package support arm 302, while holding the package P, goes upward from the waiting position 211, and then revolves as far as the transfer position 212. At this time, the feed yarn sucking device 6 operates to suck and hold the yarn end that has been picked out of the package P. The package support arm 302 moves a little downward, unwinding the yarn end from the package P, and moves upward again to suck the unwound yarn end into the yarn end sucking device 6, thus holding a predetermined length of yarn end. Subsequently, the package support arm 302 goes downward to insert the package P onto the adapter A, then returns upward to the waiting position 211.

The tray T after removal of the package P is sent out from the conveyor line $L_3$ onto the tray discharge conveyor line $L_6$.

The tray T carrying the adapter A mounted with one package P in the transfer position 212 turns in the direction of yarn winding with the rotation of the tray turning device 5. At this time, the levers 7 and 8 turn from the waiting positions to the position in which they protrude toward the center of the package P, catching by their hooks the yarn extending from the package P to the yarn end sucking device 6. Subsequently, the levers 7 and 8 turn toward unwinding the yarn from the package P and at the same time the tray T turns reversely.

On the other hand, provided on the uppermost part of the adapter A in the empty bobbin removing position 210 with the upper-stage empty bobbin B removed is the release tension adjusting guide G. The package support arm 202 goes downward, and the chuck 203 chucks the release tension adjusting guide G. Then, the package support arm 202 goes upward and at the same time turns to go downward to the transfer position 212, inserting the release tension adjusting guide G onto the adapter A with yarn removed by means of the levers 7 and 8. Then, the package support arm 202 moves upward, returning to the waiting position 210. The levers 7 and 8 also return to their waiting positions.

Subsequently, the package support arm 302, while holding the next package P, rises from the waiting position 211, and turns to the transfer position 212. At this time the yarn end sucking device 6 operates to draw out and hold the yarn end picked out from the package P. The package support arm 302 moves a little downward to unwind the yarn end from the package P, and rises again to suck the unwound yarn end into the yarn end sucking device 6, then holding the predetermined length of yarn end. Next, the package support arm 302 goes downward to insert the package P onto the adapter A, then returning to the waiting position 211.

Figure 9:
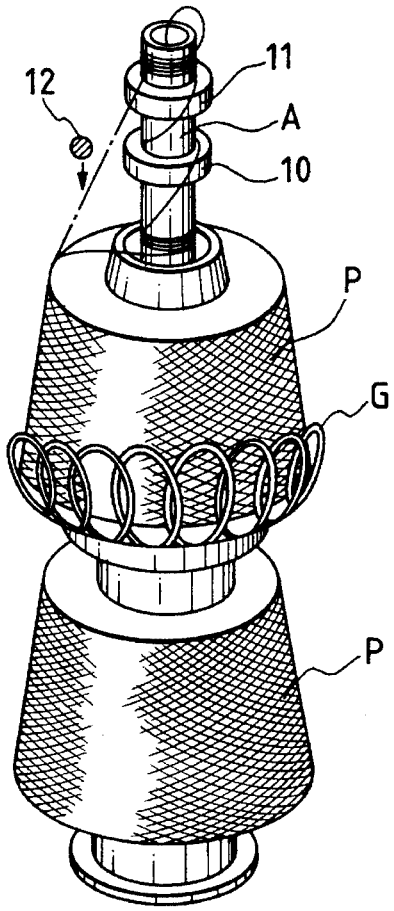
FIG. 9 is a view explaining a method for winding each yarn end of the package mounted on an adapter to the upper part of the adapter.

At the same time, when the tray turning device 5 rotates in the direction of winding of the yarn to a position where the lever 8 protrudes toward the center of the package P, two yarns drawn into the yarn end sucking device 6 are hooked by the lever 8 and are led to the lower side of the lower-stage collar section 10 of the adapter A as shown in FIG. 9, being wound one to five or six turns in the same direction as the winding of yarn on the package P. Subsequently the lever 8 moves a little upward of the upper-stage roller section 11 as indicated by an alternate long and short dash line in FIG. 8, the yarn being wound several turns on the upper side of the collar section 11. A remaining yarn end will be cut by the cutter attached to the lever 9 and then drawn into the adapter A by means of the yarn end sucking device not illustrated which is located below the transfer position 212. Required in the subsequent process is a part wound on the upper side of the collar section 11. However, if the yarn end is wound directly on this part, the yarn tends to be stretched as indicated by a one long and short dash line in FIG. 9, with the result that the yarn will be broken when the adapter A is taken up by the hanger 3 of the overhead conveyor 2 or by the hanger 101 of the package lifter 100. To prevent this, the yarn is wound in two stages as described above.

Thus the adapter A in the bobbin removing position 210 becomes empty, and is released by the stopper, advancing on the circulating conveyor line $L_1$ to stop at the transfer position 212.

Another embodiment of the empty bobbin and package conveyor system will be illustrated hereinunder.

The embodiment provides the empty bobbin and package conveyor system which comprises an overhead conveyor having suspended traveling hangers and a lifter having vertically movable pegs. In this empty bobbin and package conveyor system having the pegs and hangers which can respectively receive and deliver an empty bobbin and a new package, the hanger is of a nearly T-letter type having a first arm in the direction of travel and a second arm in the opposite direction of travel, while the pegs are also of a nearly T-letter type having first arms in the direction of travel of the hanger and second arms in the opposite direction of travel of the hanger.

The package on the second arm of the hanger oriented to the opposite direction of travel of the hanger is delivered to the second arms of the peg in the opposite direction of travel of the hanger, and at the same time the empty bobbin on the first arms of the pegs in the direction of travel of the hanger is delivered to the first arm of the hanger. Thus the function of one hanger is switched from conveying the package over to conveying the empty bobbin.

Figure 10:
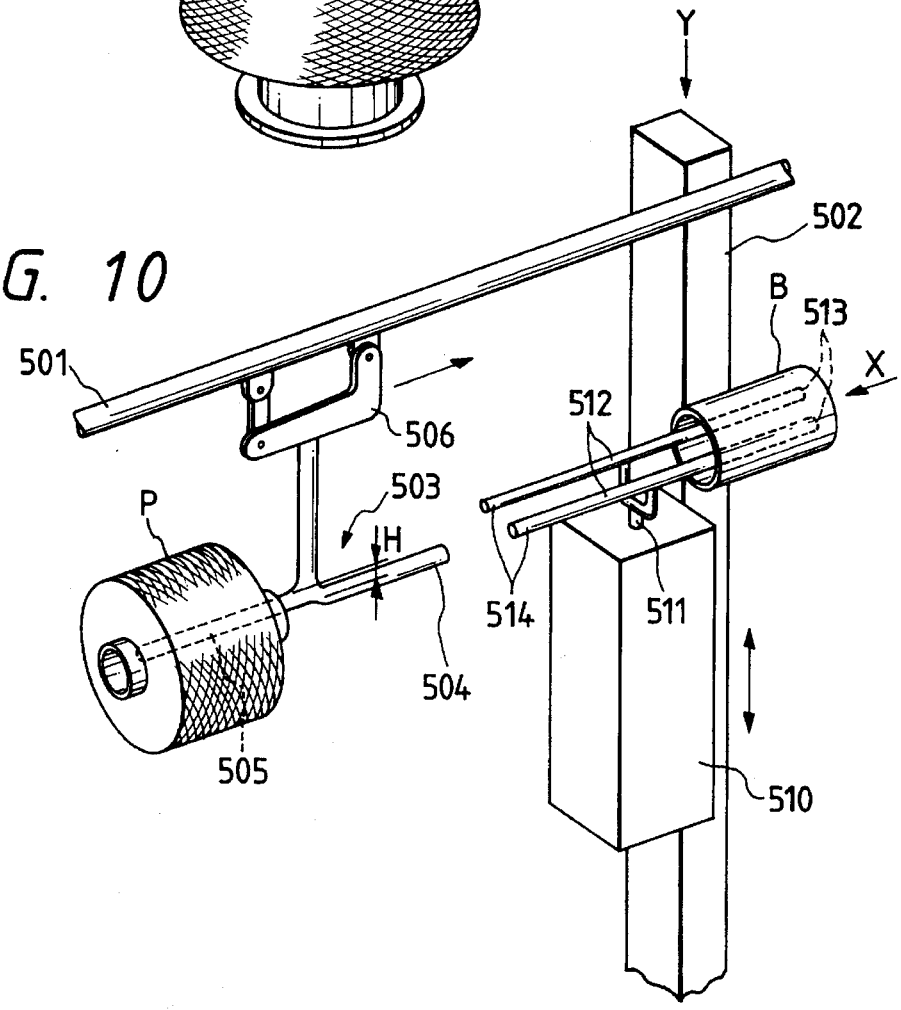
FIG. 10 is a perspective view showing another embodiment of an empty bobbin and package conveyor system according to the present invention.

In FIG. 10, a numeral 501 denotes an overhead conveyor, and a numeral 502 refers to a lifter. A hanger 503 of the overhead conveyor 501 is of a nearly T-letter type, and has a first arm 504 in the direction of travel of the hanger and a second arm 505 in the opposite direction of travel of the hanger. Between the first arm 504 and the second arm 505 there is provided a difference in height H. Inserted on either one of the first arm 504 and the second arm 505 is a package or an empty bobbin and accordingly the center of gravity is off from the center of the hanger 503. The hanger 503 is fixedly installed to a hanger bracket 506 and suspended at the front and rear part of the hanger bracket 506 from the overhead conveyor 501, thereby holding the hanger 503 in a level state. The package P is inserted in the second arm.

The lifter 502 has a vertically movable elevating feeder 510, on which is installed a Y-shaped support 511 which can rotate through 90 degrees each turn. Two parallel pegs 512 are secured at the top ends of this Y-shaped support 511. The pegs 512 in the direction of travel of the hanger are the first arms 513, while those in the opposite direction of travel of the hanger are the second arms 514. On the first arms 513 are inserted the bobbin B.

Figure 11:
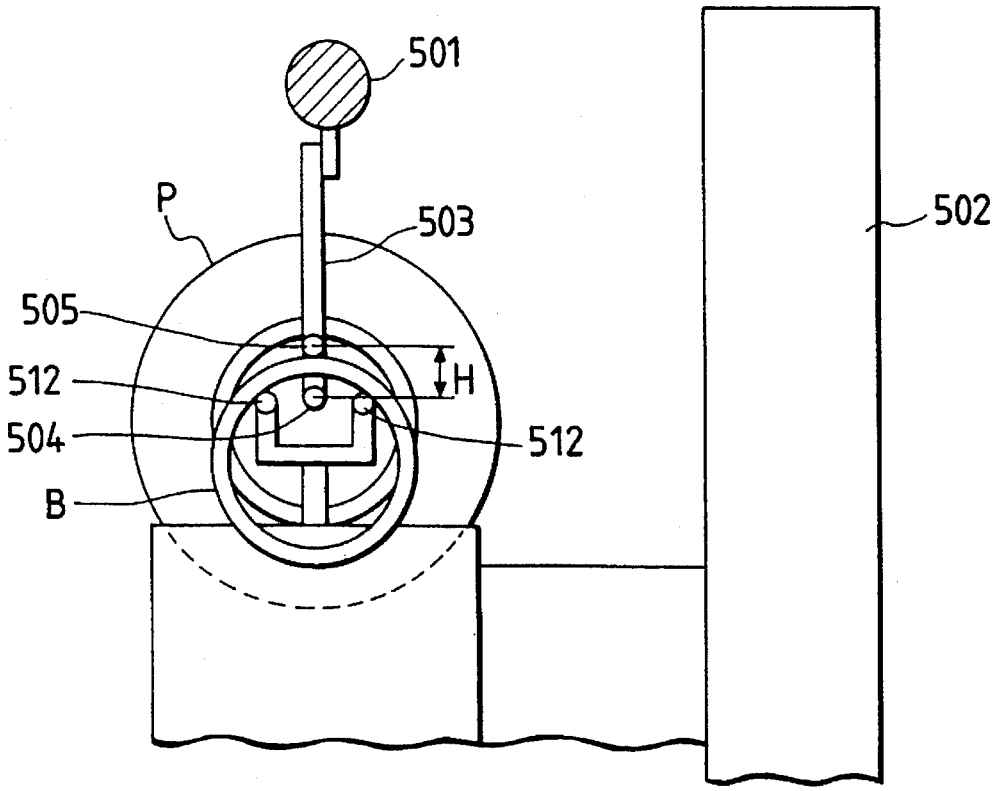
FIG. 11 is a view taken in the direction of the arrow X in FIG. 10.

In FIG. 11, the first arm 504 of the hanger 03 passes through between the two pegs 512, and the second arm 505 of the hanger 503 passes through between the two pegs 512. Therefore, the package P inserted over the second arm 505 of the hanger 503 is delivered over to the second arms (inner) of the pegs 512 with room provided. The bobbin B inserted on the first arms (outer) is also transferred to the first arm 504 of the hanger 503 with room provided.

Figure 12:
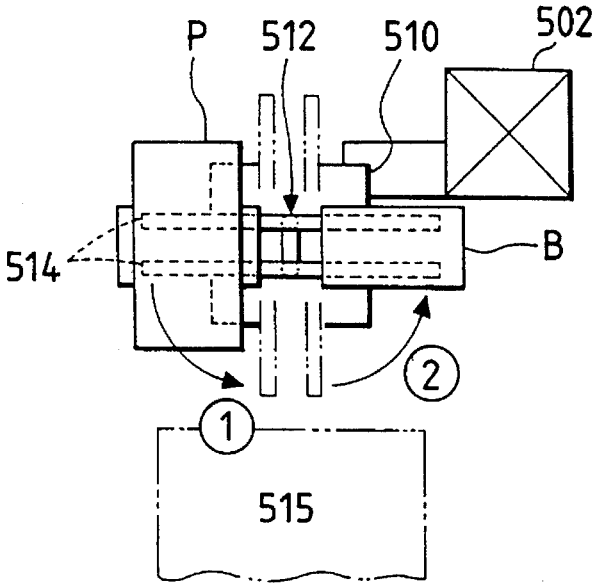
FIG. 12 is a view taken in the direction of the arrow Y in FIG. 10.

In FIG. 12, the elevating feeder 510 goes downward to transfer the package P to the second arms 14 of the pegs. When the package P is thus transferred, the pegs 512 turn through 90 degrees (to the direction ①), the package P facing the truck 515. Then, the package P is pushed out by means of a pusher not illustrated. Receiving an empty bobbin B from the truck 515, the second arms 514 of the pegs make a further 90-degree turn (to the direction ②). The elevating feeder 510 rises to return to the state in FIG. 10. In this case, the first arm 513 and the second arm 514 are oriented reversely. However, since these arms are symmetrical in shape in the direction of travel, operation can be done properly.

Figure 13:
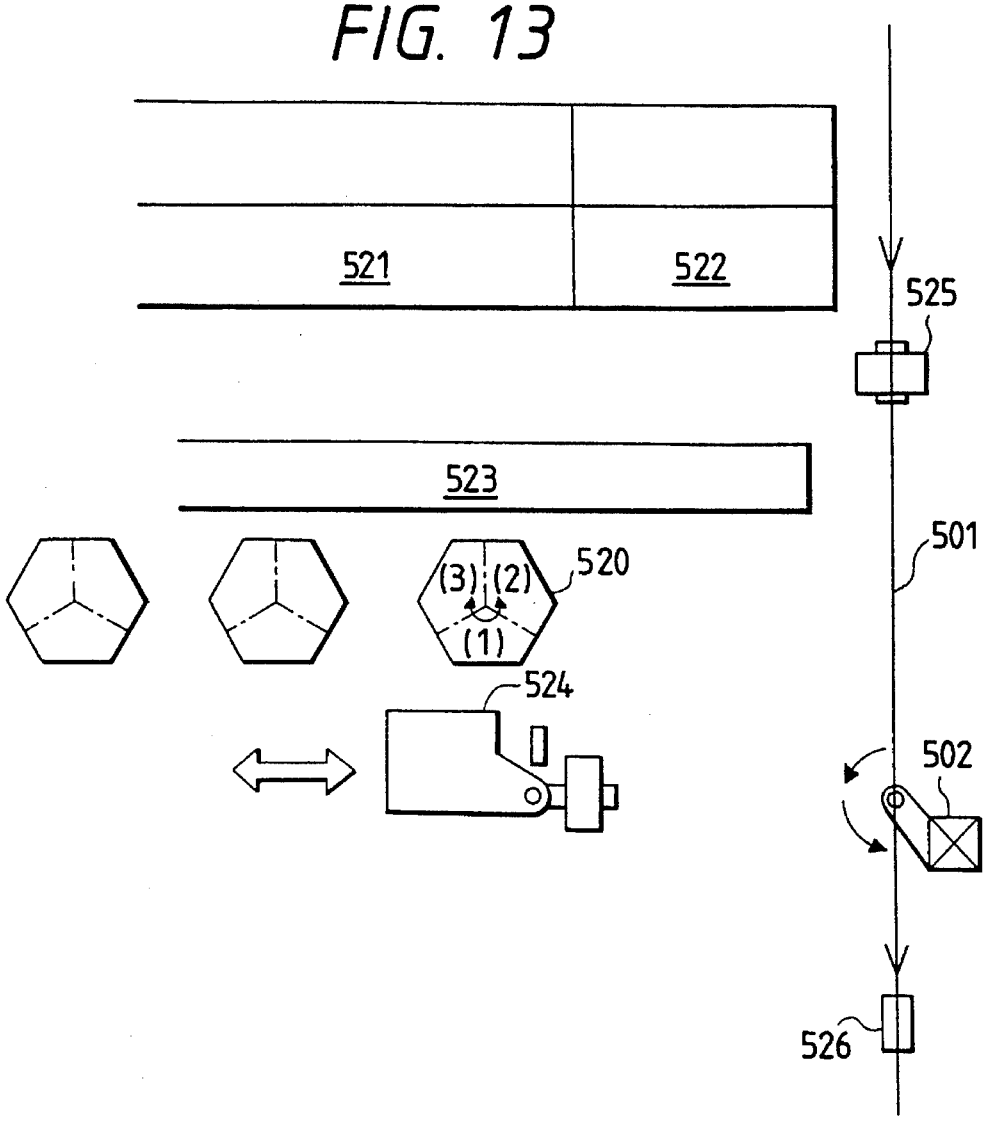
FIG. 13 is a plan view showing a yarn supply system of a draw false-twist texturing machine using the conveyor system.
Figure 14:
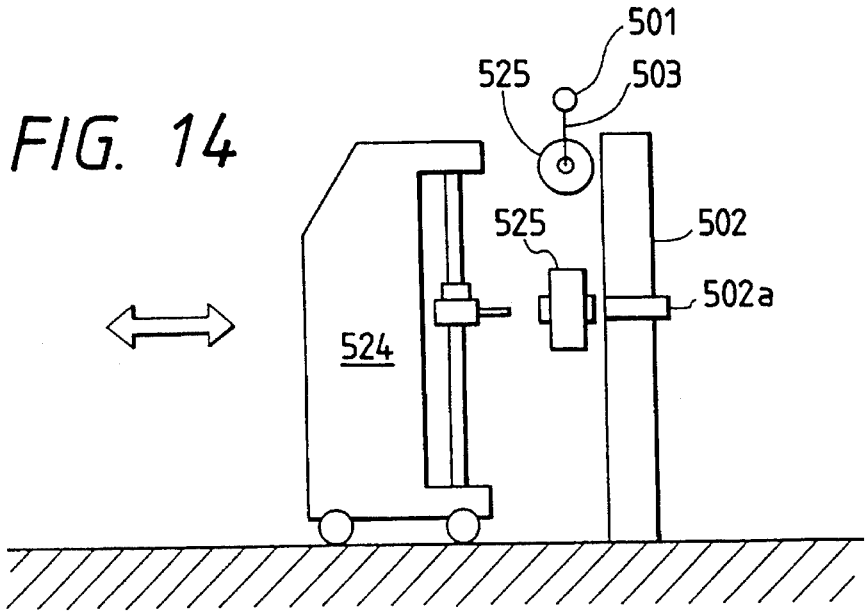
FIG. 14 is a side view showing a yarn supply system.

FIGS. 13 and 14 show the yarn feeding system of the draw false-twist texturing machine using the above-described empty bobbin and package conveyor system. FIG. 13 is a plan view and FIG. 14 is a side view. In FIG. 13, a numeral 520 denotes a rotary creel; a numeral 521 refers to a body unit; a numeral 522 is a drive end; and a numeral 523 is a peg circulating conveyor located around a primary heater and for discharging a processed package. In this conveyor system is provided a feed yarn changing truck 523 traveling along the row of the rotary creels 520; the overhead conveyor 501 is installed on the drive end 522 side; and the lifter is disposed at the intersection between the overhead conveyor 501 and the feed yarn changing truck 524. The feed yarn package 525 from the hanger 503 of the overhead conveyor 501 is transferred to the pegs of the lifter 2', and at the same time the empty bobbin on the pegs is transferred to the hanger 503. The lifter 502 turns the feed yarn package 525 through 90 degrees when lowering. The feed yarn package 525 that has moved down to the end of downward stroke is pushed out by a pusher 502*a* onto the feed yarn changing truck 524. At the same time, the pegs of the lifter 502 receive an empty bobbin from the feed yarn changing truck 524. This feed yarn changing truck 524 travels toward the specific rotary creel 520. Back in FIG. 13, the feed yarn changing truck 524 rotates the rotary creel 520 to judge whether or not the parts ① to ③ require replacement. After the replacement of the parts ① to ③ has been performed, the feed yarn changing truck receives an empty bobbin, and the feed yarn package will be consumed. Then, the operator ties the tail of the replaced yarn. The overhead conveyor 501 transfers an empty bobbin from one hanger and at the same time receives a feed yarn package, and therefore, can carry out high-efficiency conveying operation with little waiting time of the lifter 502, well corresponding with the capacity of the feed yarn changing truck 524. The empty bobbin and package conveyor system described above is applicable not only to the conveyance of feed yarn packages to the draw false-twist texturing machine but also to the conveyance of processed packages using an auto doffer. That is, it is usable for conveying wound packages by use of the auto doffer from an automatic take-up motion. Furthermore, it is possible to use the conveyor system in changing an empty bobbin to a package and vice versa.

The empty bobbin and package conveyor system according to this embodiment comprises an overhead conveyor with suspended traveling hangers and a lifter having vertically movable pegs, the pegs and hangers being capable of receiving and transferring an empty bobbin and a package respectively. In this empty bobbin and package conveyor system, the hanger is nearly of T-letter type having a first arm in the direction of travel and a second arm in the opposite direction of travel. The pegs also are nearly of T-letter type having a first arm in the direction of travel of the hanger and a second arm in the opposite direction of travel of the hanger. The package on the second arm of the hanger in the opposite direction of travel of the hanger is transferred to the second arms of the pegs in the opposite direction of travel of the hanger, and at the same time the empty bobbin on the first arms of the pegs in the direction of travel of the hanger is transferred to the first arm of the hanger in the direction of travel of the hanger and one hanger is switched from package conveyance to empty bobbin conveyance, thereby improving the efficiency of the overhead conveyor, decreasing the waiting time of the lifter, and accordingly shortening the cycle time.

What is claimed is:

1. A system for connecting a winder and a double twister, comprising:

at least a first circulating conveyor for conveying packages on trays, a yarn end picking device for picking out a yarn end of a package transported from the winder, package recirculation means for returning a package from which a yarn end has not been picked out by the yarn end picking device from the yarn end picking device back to the yarn end picking device, a package loader for putting a package from which a yarn end has been picked out onto a tray circulated on the first circulating conveyor, a transfer device for removing the package from the tray circulated on the first circulating conveyor and transferring the package onto a conveyor for transporting the package to the double twister, for receiving an empty bobbin transported from the double twister, and for mounting the empty bobbin onto a tray circulated on the first circulating conveyor, a bobbin mover for removing the empty bobbin from the tray circulated on the first circulating conveyor, yarn end preparing means, disposed substantially on the first circulating conveyor between the package loader and the bobbin mover, for preparing the yarn end of a package on a tray circulated on the first circulating conveyor, and a bobbin stripper for stripping off yarn remaining on the empty bobbin received from the bobbin mover.

2. A system for connecting a winder and a double twister, comprising:

at least a first circulating conveyor for conveying packages on trays, a yarn end picking device for picking out a yarn end of a package set on a tray, package recirculation means for returning a package from which a yarn end has not been picked out by the yarn end picking device from the yarn end picking device back to the yarn end picking device, a package loader for taking up at least a first package and a second package from which a yarn end has been picked out and inserting the first and second package onto an adapter to thereby produce a two-piled package, a package lifter for receiving an empty two-piled bobbin mounting adapter from an overhead conveyor, mounting the adapter on a tray circulated on the first circulating conveyor, and transferring a full two-piled package from a tray circulated on the first circulating conveyor to the overhead conveyor, a bobbin mover for removing an empty bobbin circulating on the circulating conveyor from an adapter, yarn end preparing means, disposed substantially on the first circulating conveyor between the package loader and the bobbin mover, for preparing the yarn end of a two-piled package, and a bobbin stripper for stripping off yarn remaining on the empty bobbin received from the bobbin mover.

3. The system of claim 2, wherein the bobbin mover comprises a chuck support arm having a chuck, the chuck support arm being vertically moveable between an empty bobbin removing position and a waiting position and being horizontally rotatable between an adapter mounted on a tray and a bobbin stripper for discharging an empty bobbin removed from the adapter, and wherein the package loader comprises a package support arm, the package support arm being vertically moveable between a waiting position for receiving a package and an upper position and being horizontally rotatable toward and away from a transfer position for mounting a package on an adapter.

4. A system for connecting a winder and a double twister, comprising:

at least a first circulating conveyor for conveying packages on trays, a yarn end picking device for picking out a yarn end of a package set on a tray, a package loader for taking up at least a first package and a second package from which a yarn end has been picked out and inserting the first and second package onto an adapter to thereby produce a full two-piled package, a package lifter for receiving an empty two-piled bobbin mounting adapter from an overhead conveyor, mounting the adapter on a tray circulated on the first circulating conveyor, and transferring a full two-piled package to an overhead conveyor, a bobbin mover for removing an empty bobbin circulating on the circulating conveyor from an adapter, and a bobbin stripper for stripping off yarn remaining on the empty bobbin received from the bobbin mover, wherein the adapter comprises a lower-stage collar defining a lower part and an upper stage collar defining an upper part and wherein the yarn end picking device comprises a yarn end preparing apparatus comprising:

a device for revolving a tray, a yarn end sucking device for sucking and holding a predetermined length of yarn end from a package that has had its yarn end picked out, a first lever for moving toward a package from a waiting position, hooking a yarn from the package at a yarn hooking position, and moving to a retreated position in which the hooked yarn is moved away from the package;

a second lever for moving toward the package from the waiting position, moving to the yarn hooking position, moving to the retreated position, and for moving vertically between the lower part of the lower-stage collar section of the adapter and the upper part of the upper-stage collar section of the adapter, and a third lever with a cutter for cutting the yarn below the yarn end sucking device.

5. A system for connecting a winder and a double twister, comprising:

a yarn end picking device for picking out a yarn end of a package set on a tray, a package lifter for receiving an empty two-piled bobbin mounting adapter from an overhead conveyor, mounting the adapter on a circulating conveyor line, and transferring a full two-piled package mounting adapter to an overhead conveyor, a bobbin mover for removing an empty bobbin circulating on the circulating conveyor line from an adapter, a package loader for taking up a package from which a yarn end has been picked out from a tray and inserting the package onto an adapter, and a bobbin stripper for stripping off yarn remaining on the empty bobbin received from the bobbin mover, wherein the package lifter comprises a package hanger having an empty bobbin hook and a package hook, and wherein the package hanger is moveable to at least one of a first position for taking up a package mounting adapter, a second position above the first position, and a third position above the second position, and further comprising a plurality of spaced, substantially L-shaped hangers suspended from the overhead conveyor, each of the suspended hangers having a rear wall with an opening therein and two legs, each of the two legs defining a front end and a rear end and each of the two legs defining swelling sections substantially adjacent the front end and the rear end, the suspended hangers and the package hanger being mutually configured such that an empty bobbin mounting adapter is deliverable by a suspended hanger to the empty bobbin hook when the package hanger is in the second position, a suspended hanger is moveable toward the package hook when the package hanger is in the third position, and a package mounting adapter is retrievable by a suspended hanger from the package hook when the package hanger is in the second position.

6. The system of claim 5, wherein the overhead conveyor moves the suspended hangers at a substantially fixed speed and wherein the suspended hangers are mutually spaced at a substantially fixed spacing.

7. A system for connecting a winder and a double twister, comprising:

at least a first circulating conveyor for conveying packages on trays, a yarn end picking device for picking out a yarn end of a package set on a tray, a package loader for taking up at least a first package and a second package from which a yarn end has been picked out and inserting the first and second package onto an adapter to thereby produce a full two-piled package, a package lifter for receiving an empty two-piled bobbin mounting adapter from an overhead conveyor, mounting the adapter on a tray circulated on the first circulating conveyor, and transferring a full two-piled package to an overhead conveyor, a bobbin mover for removing an empty bobbin circulating on the circulating conveyor from an adapter, and a bobbin stripper for stripping off yarn remaining on the empty bobbin received from the bobbin mover, wherein the bobbin stripper comprises:

a chuck for grasping the exterior of an empty bobbin, a yarn suction pipe located above the chuck, and a pusher slidably supported in the yarn suction pipe for moving downward and for pushing an empty bobbin downward, wherein the chuck scrapes yarn from the exterior of the empty bobbin as the bobbin is pushed downward by the pusher and wherein the suction pipe applies a suction force to the yarn scraped from the exterior of the empty bobbin to thereby remove the yarn scraped from the exterior of the empty bobbin.

8. A system for conveying bobbins and packages, comprising:

an overhead conveyor, a substantially T-shaped hanger suspended from the overhead conveyor for receiving empty bobbins and for delivering full packages, the hanger defining a travel direction, the hanger having a first arm oriented substantially in the travel direction and a second arm oriented in a direction substantially opposite to the travel direction, a vertically moveable lifter having substantially T-shaped pegs for receiving full packages and for delivering empty bobbins, the pegs having a first arm oriented substantially in the travel direction defined by the hanger and a second arm oriented in a direction substantially opposite to the travel direction defined by the hanger, whereby a full package is transferable from the second arm of the hanger to the second arm of the pegs at substantially the same time that an empty bobbin is transferable from the first arm of the pegs to the first arm of the hanger.

9. A system for conveying bobbins and packages, comprising:

an overhead conveyor, a package hanger having an empty bobbin hook and a package hook, wherein the package hanger is moveable to at least one of a first position for taking up a package mounting adapter, a second position above the first position, and a third position above the second position, a plurality of spaced, substantially L-shaped hangers suspended from the overhead conveyor, each of the suspended hangers having a rear wall with an opening therein and two legs, each of the two legs defining a front end and a rear end and each of the two legs defining swelling sections substantially adjacent the front end and the rear end, means for moving a suspended hanger toward the empty bobbin hook to thereby deliver an empty bobbin mounting adapter into the empty bobbin hook, the empty bobbin mounting adapter having a collar section and a head section, means for moving the package hanger upward to the third position, whereby the collar section of the empty bobbin mounting adapter is raised above the swelling sections, means for moving the suspended hanger toward the package hook, whereby the head section of the empty bobbin mounting adapter passes through the opening in the rear wall of the suspended hanger and the collar section of the empty bobbin mounting adapter passes over the swelling sections, means for catching a package mounting adapter held at the package hook with the suspended hanger, the package mounting adapter having a collar section, means for moving the package hanger downward to thereby position the collar section of the package mounting adapter between the swelling sections, and means for moving the suspended hanger away from the package hook.

* * * * *